US010514196B2

(12) United States Patent
Long

(10) Patent No.: US 10,514,196 B2
(45) Date of Patent: Dec. 24, 2019

(54) CONDENSATE DRAIN PAN PORT

(71) Applicant: Carrier Corporation, Jupiter, FL (US)

(72) Inventor: Richard Long, Danville, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/873,747

(22) Filed: Jan. 17, 2018

(65) Prior Publication Data

US 2018/0202704 A1 Jul. 19, 2018

Related U.S. Application Data

(60) Provisional application No. 62/447,762, filed on Jan. 18, 2017.

(51) Int. Cl.

| | |
|---|---|
| ***F25D 21/14*** | (2006.01) |
| ***F24F 13/22*** | (2006.01) |
| ***F24D 19/08*** | (2006.01) |

(52) U.S. Cl.

CPC ..... *F25D 21/14* (2013.01); *F24D 19/08* (2013.01); *F24F 13/222* (2013.01); *F24F 2013/227* (2013.01)

(58) Field of Classification Search

CPC ... F24D 19/08; F24F 13/222; F24F 2013/227; F25D 21/14

USPC ..... 62/285–291

See application file for complete search history.

(56) References Cited

U.S. PATENT DOCUMENTS

| | | | | |
|---|---|---|---|---|
| 4,693,091 | A | 9/1987 | O'Mara et al. | |
| 4,835,984 | A | 6/1989 | Vyavaharkar et al. | |
| 6,931,882 | B1 | 8/2005 | Yang | |
| 7,003,972 | B2 | 2/2006 | Eom et al. | |
| 7,284,388 | B2 | 10/2007 | Yoshida | |
| 7,430,877 | B2 | 10/2008 | Davenport et al. | |
| 7,878,019 | B2 | 2/2011 | Cantolino | |
| 2009/0084127 | A1 | 4/2009 | Nakata et al. | |
| 2010/0212347 | A1* | 8/2010 | Kim | B60H 1/3233 62/285 |
| 2011/0179818 | A1* | 7/2011 | Hast | F25D 21/14 62/290 |
| 2013/0312432 | A1* | 11/2013 | Hodges | B64D 13/06 62/56 |
| 2015/0089969 | A1* | 4/2015 | Nakamura | F25D 21/14 62/285 |
| 2015/0245721 | A1 | 9/2015 | Nugroho | |
| 2016/0001637 | A1 | 1/2016 | Kume et al. | |
| 2018/0195790 | A1* | 7/2018 | Fushimi | F24F 1/0047 |

FOREIGN PATENT DOCUMENTS

| | | | |
|---|---|---|---|
| CN | 100339659 | C | 9/2007 |
| CN | 102954009 | A | 3/2013 |
| JP | H04347424 | A | 12/1992 |
| JP | 2005283057 | A | 10/2005 |
| JP | 4347424 | B2 | 10/2009 |

* cited by examiner

*Primary Examiner* — Filip Zec

(74) *Attorney, Agent, or Firm* — Cantor Colburn LLP

(57) ABSTRACT

An HVAC/R unit, a condensate drain pan port insert, and a condensate drain pan are provided. The condensate drain pan includes a condensate drain pan port with a port housing having an upper end and a lower end, a condensate wall extending upward from the lower end, and an air wall extending downward from the upper end and being configured to limit an airflow through the port housing.

10 Claims, 4 Drawing Sheets

CONDENSATE DRAIN PAN PORT

CROSS REFERENCE TO RELATED APPLICATION

The present application is a nonprovisional patent application, and claims the priority benefit of U.S. Application Ser. No. 62/447,762, filed Jan. 18, 2017, the text and drawings of which are hereby incorporated by reference in its entirety.

TECHNICAL FIELD OF THE DISCLOSED EMBODIMENTS

The presently disclosed embodiments generally relate to condensate drain pans and, more particularly, to condensate drain pan ports.

BACKGROUND OF THE DISCLOSED EMBODIMENTS

In a conventional heating, ventilation, and air conditioning or refrigeration (HVAC/R) cycle, a compressor compresses a refrigerant and delivers the compressed refrigerant to a downstream condenser. From the condenser, the refrigerant passes through an expansion device, and subsequently, to an evaporator. The refrigerant from the evaporator is returned to the compressor. In a split system heating and/or cooling system, the condenser may be known as an outdoor heat exchanger and the evaporator as an indoor heat exchanger, when the system operates in a cooling mode. In a heating mode, their functions are reversed.

During a cooling mode operation, a blower circulates air through the casing of the fan coil assembly, where the air cools as it passes over the evaporator coil. The blower then circulates the air to a space to be cooled. Typically, a refrigerant is enclosed in piping that is used to form the evaporator coil. If the temperature of the evaporator coil surface is lower than the dew point of air passing over it, the evaporator coil removes moisture from the air. Specifically, as air passes over the evaporator coil, water vapor condenses on the evaporator coil. The condensate drain pan of the evaporator assembly collects the condensed water as it drips off of the evaporator coil. The collected condensation may then drain out of the condensate drain pan through at least one drain hole or port in the condensate drain pan.

However, during some conditions, such as the exemplary condition where positive static air pressure exists in the evaporator, the flow of collected condensation is blocked or significantly impeded by airflow at the condensate drain pan port. Such impedance may elevate the amount of collected condensation in the condensate drain pan and cause the condensation to flow over the top edge of the condensate drain pan and onto blower, furnace, and/or other HVAC/R equipment. Therefore, there exists a need in the art for a condensate drain pan port that allows proper drainage of condensate drain pans.

SUMMARY OF THE DISCLOSED EMBODIMENTS

In one aspect, an HVAC/R unit is provided. The HVAC/R unit includes an evaporator coil, and a port configured to remove condensate away from the evaporator coil. The port includes a port housing having an upper end and a lower end, a condensate wall extending upward from the lower end, and an air wall extending downward from the upper end and being configured to limit an airflow through the port housing.

The condensate wall may include an upper edge and the air wall includes a lower edge. The upper edge may be substantially radially aligned with the lower edge. The upper edge may be radially offset a predetermined radial distance from the lower edge. The upper edge and the lower edge may be straight. The condensate wall may be axially spaced a predetermined axial distance from the air wall. The HVAC/R unit may further include a drainage opening in the condensate wall.

In one aspect, a condensate drain pan port insert is provided. The insert includes a condensate wall extending to an upper edge along a first plane, and an air wall extending to a lower edge along a second plane spaced axially from the first plane and being configured to limit an airflow through the port housing.

The insert may further include at least one connecting member extending between the condensate wall and the air wall. The insert may further include a drainage opening in the condensate wall. The insert may further include an air wall support extending from the lower edge along the second plane.

In one aspect, a condensate drain pan is provided. The pan includes an outer wall having a condensate drain pan port. The condensate drain pan port has a port housing having an upper end and a lower end, a condensate wall extending upward from the lower end, and an air wall extending downward from the upper end and configured to limit an airflow through the port housing.

The condensate wall may include an upper edge and the air wall may include a lower edge. The upper edge may be substantially radially aligned with the lower edge. The upper edge may be radially offset a predetermined radial distance from the lower edge. The upper edge and the lower edge may be straight. The condensate wall may be axially spaced a predetermined axial distance from the air wall. The pan may further include a drainage opening in the condensate wall.

BRIEF DESCRIPTION OF DRAWINGS

The embodiments and other features, advantages and disclosures contained herein, and the manner of attaining them, will become apparent and the present disclosure will be better understood by reference to the following description of various exemplary embodiments of the present disclosure taken in conjunction with the accompanying drawings, wherein.

DETAILED DESCRIPTION OF THE DISCLOSED EMBODIMENTS

Figure 1:
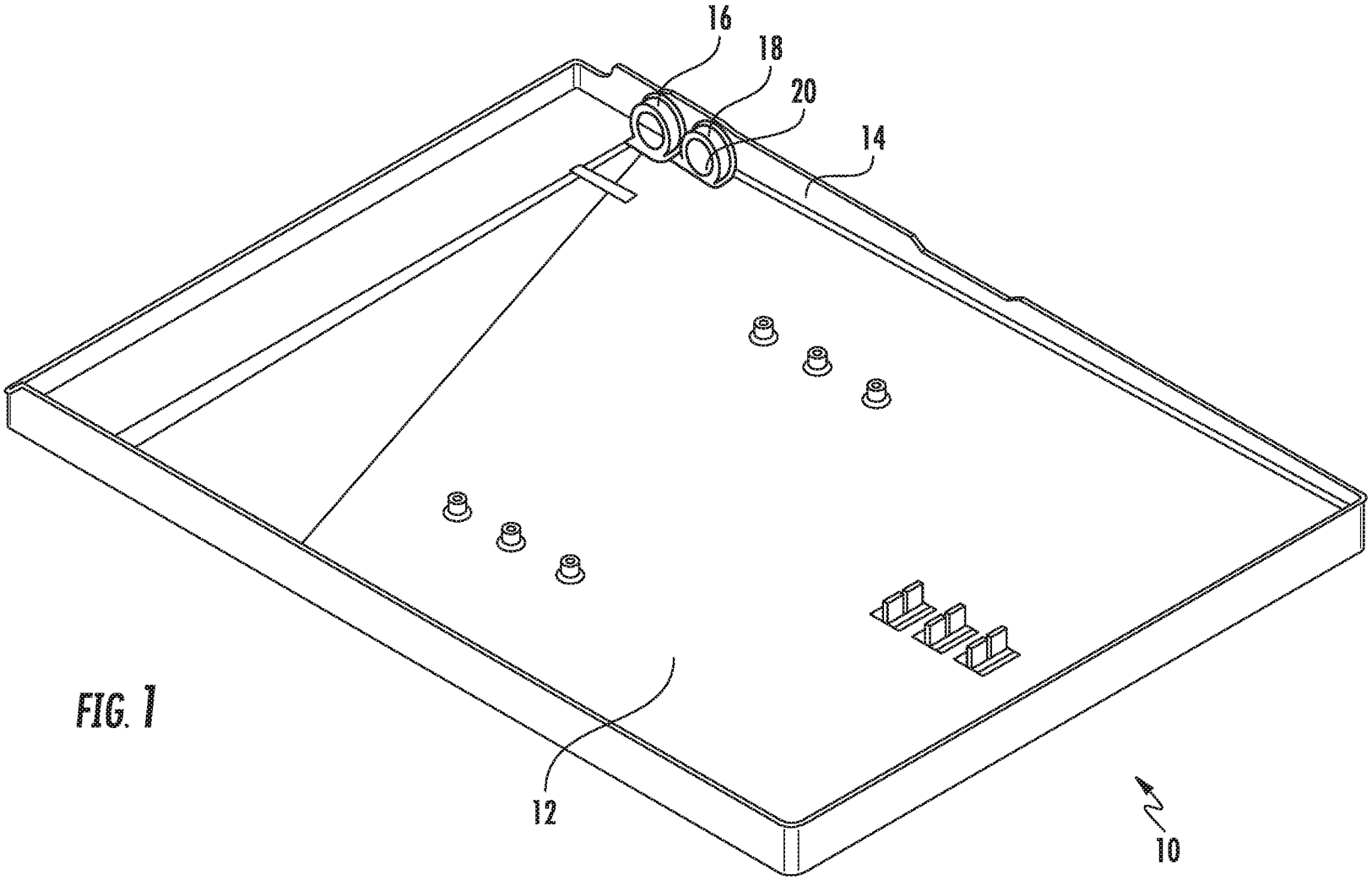
FIG. 1 is a perspective view of a condensate drain pan in accordance with an embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

Referring now to FIG. 1, a condensate drain pan 10 in accordance with one or more embodiments of the present disclosure is illustrated. The condensate drain pan 10 forms part of an HVAC/R unit (not illustrated) having a fan coil assembly, a furnace, a blower, and/or an evaporator coil in one or more embodiments of the present disclosure. The condensate drain pan 10 includes a lower wall 12, at least one outer wall 14, and one or more condensate drain pan ports 16 disposed at or in the at least one outer wall 14. The condensate drain pan 10 of one or more embodiments not illustrated includes one or more ports 16 disposed at or in the lower wall 12 or another portion of the condensate drain pan 10. The condensate drain pan 10 illustrated in FIG. 1 includes the condensate drain pan port 16 and the overflow port 18. The overflow port 18 includes a lip 20 preventing collected condensate from flowing through the overflow port 18 until it has reached a level above the upper edge of the lip 20. In additional embodiments of the present disclosure, the condensate drain pan 10 includes a plurality of ports 16 and/or a plurality of or no overflow ports 18.

Figure 2:
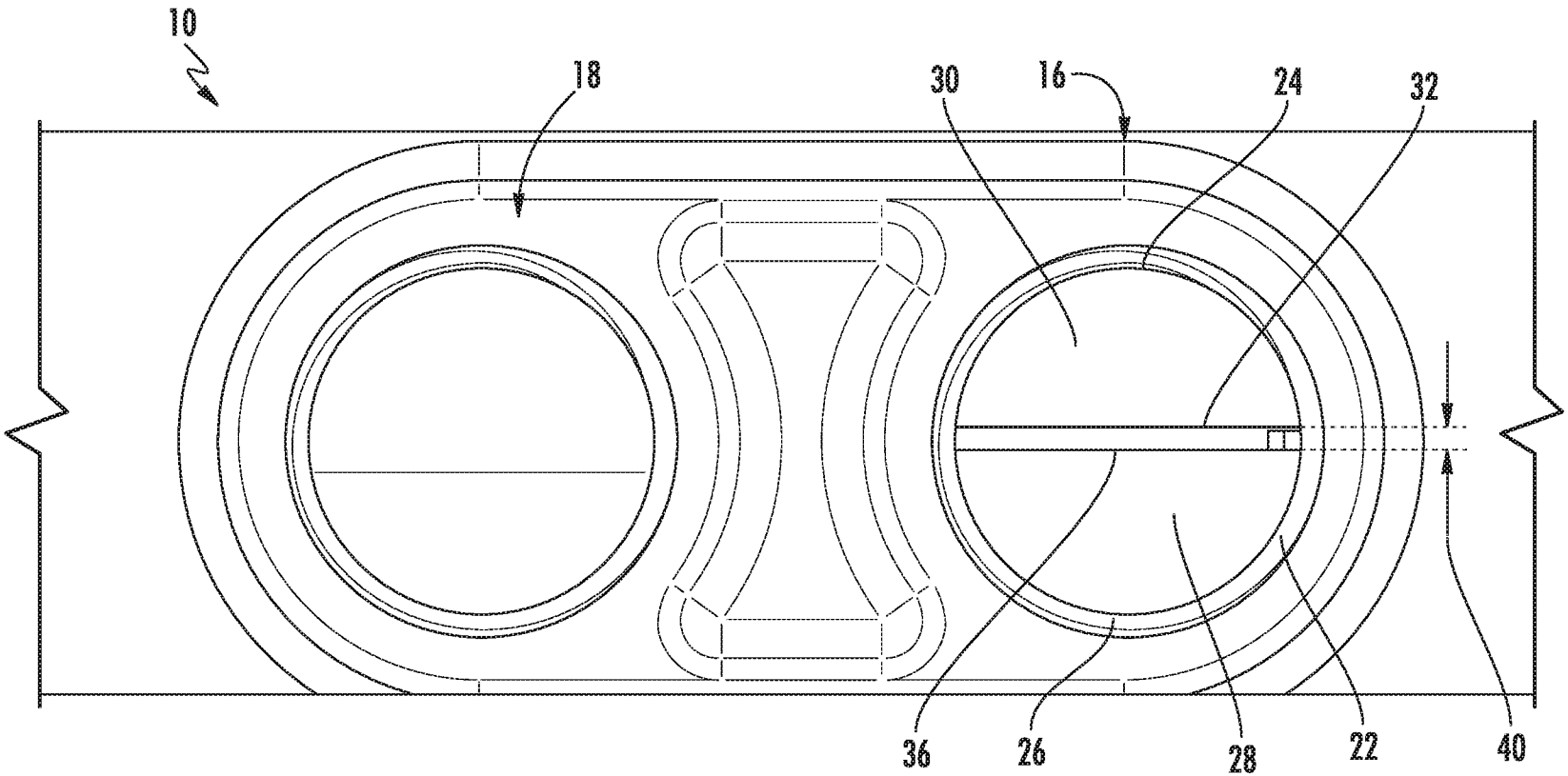
FIG. 2 is an elevation view of a condensate drain pan port in accordance with an embodiment of the present disclosure.
Figure 3:
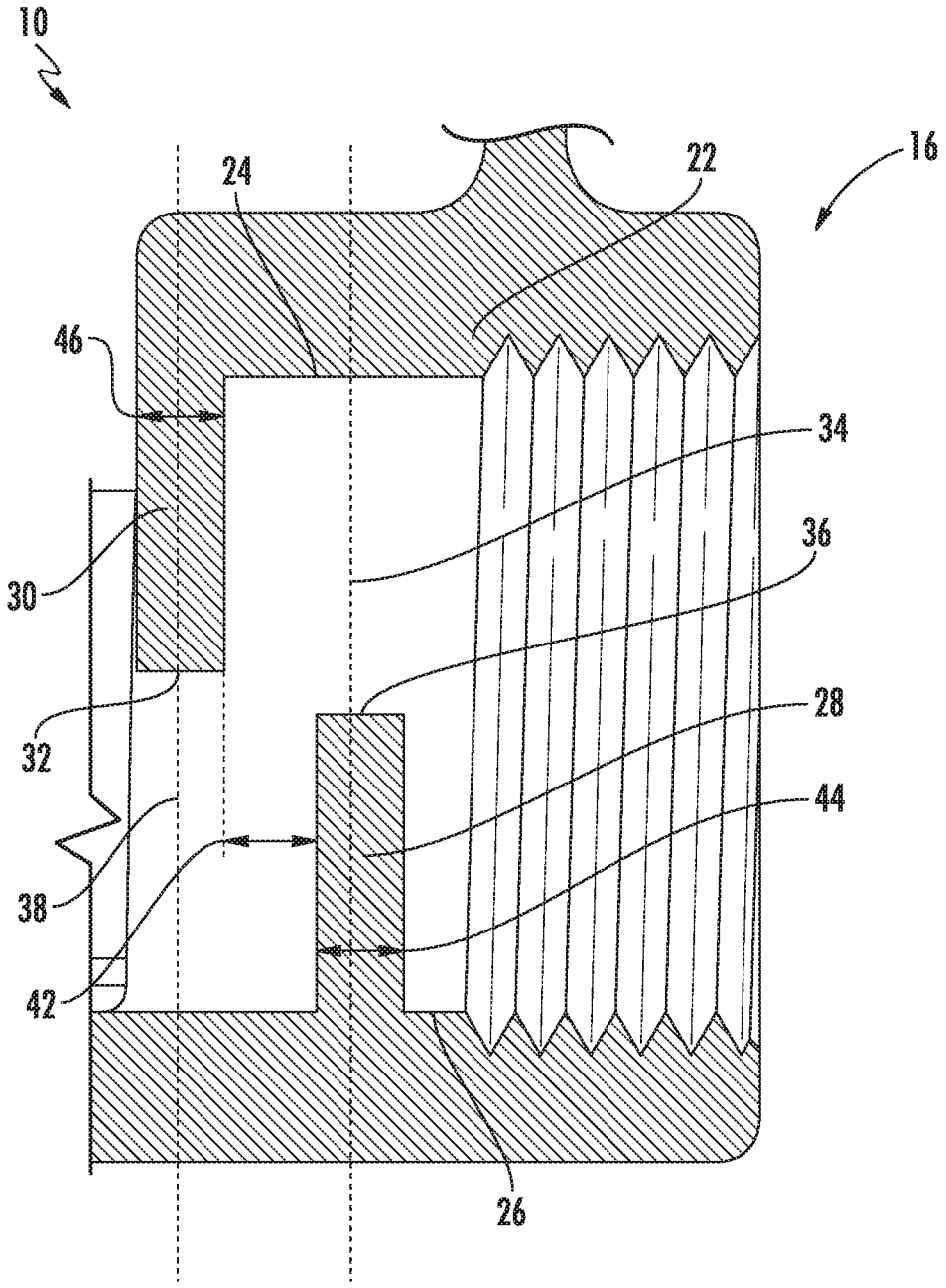
FIG. 3 is a cross-sectional view of a condensate drain pan port in accordance with an embodiment of the present disclosure.

Referring now to FIGS. 2 and 3, the condensate drain pan 10 and/or the condensate drain pan port 16 of an embodiment includes a port housing 22 having an upper end 24 and a lower end 26. The port 16 forms part of an HVAC/R unit (not illustrated) having a fan coil assembly, a furnace, a blower, and/or an evaporator coil in one or more embodiments of the present disclosure. The port housing 22 in the illustrated embodiment is the portion of the drain pan 10 forming the drain pan port 16, as best illustrated in FIG. 2. The port housing 22 may be separately formed from the drain pan 10 in one or more embodiments not illustrated.

The drain pan port 16 includes a condensate wall 28 extending upward from the lower end 26. The condensate wall 28 is configured to at least partially impede the flow of collected condensate in the drain pan 10 through the drain pan port 16. The condensate wall 28 includes an upper edge 36. In the illustrated embodiment, the upper edge 36 is straight. In one or more embodiments not illustrated, the upper edge 36 is curved, includes multiple edges, or is otherwise not straight. As best illustrated in FIG. 3, the condensate wall 28 extends along a first plane 34.

The drain pan port 16 further includes an air wall 30 extending downward from the upper end 24. The air wall 30 is configured to limit an airflow through the port housing 22. The air wall 30 includes a lower edge 32. In the illustrated embodiment, the lower edge 32 is straight. In one or more embodiments not illustrated, the lower edge 32 is curved, includes multiple edges, or is otherwise not straight. As best illustrated in FIG. 3, the air wall 30 extends along a second plane 38. However, in one or more embodiments not illustrated the condensate wall 28 and/or the air wall 30 do not extend along the planes 34, 38, are angled along another plane, and/or do not extend radially in the drain pan port 16.

The upper edge 36 is substantially radially aligned with the lower edge 32 in one or more embodiments. As best illustrated in FIG. 2, the upper edge 36 of one embodiment is radially offset a predetermined radial distance 40 from the lower edge 32. The radial distance 40 is between 1/64" (0.40 mm) and 1/4" (6.35 mm) in one embodiment, between 1/32" (0.79 mm) and 1/8" (3.18 mm) in another embodiment, about 1/16" (1.59 mm) in another embodiment, greater than 1/4" (6.35 mm) in one embodiment, and less than 1/64" (0.40 mm) in another embodiment. In a further embodiment, the upper edge 36 overlaps the lower edge 32 such that the radial distance 40 does not exist or is a negative value. In one or more embodiments, the radial distance 40 between the upper edge 36 and the lower edge 32 allows the collected condensate to flow over the upper edge 36 while, due to surface tension of the collected condensate at the upper edge 36, the lower edge 32 is positioned low enough to block or significantly impede airflow through the drain pan port 16.

As further illustrated in FIG. 3, the condensate wall 28 is axially spaced a predetermined axial distance 42 from the air wall 30 in an embodiment. The axial distance 42 is between 1/64" (0.40 mm) and 1" (25.40 mm) in one embodiment, between 1/16" (1.59 mm) and 1/2" (12.7 mm) in another embodiment, about 1/8" (3.175 mm) in another embodiment, greater than 1" (25.4 mm) in another embodiment, and less than 1/64" (0.40 mm) in another embodiment. A condensate wall width 44 is between 1/64" (0.40 mm) and 1" (25.40 mm) in one embodiment, between 1/16" (1.59 mm) and 1/2" (12.7 mm) in another embodiment, about 1/8" (3.175 mm) in another embodiment, greater than 1" (25.40 mm) in another embodiment, and less than 1/64" (0.40 mm) in another embodiment. An air wall width 46 is between 1/64" (0.40 mm) and 1" (25.40 mm) in one embodiment, between 1/16" (1.59 mm) and 1/2" (12.7 mm) in another embodiment, about 1/8" (3.175 mm) in another embodiment, greater than 1" (25.40 mm) in another embodiment, and less than 1/64" (0.40 mm) in another embodiment. The axial distance 42, the radial distance 40, the condensate wall width 44, and/or the air wall width 46 of one or more embodiments of the present disclosure allow the air wall 30 to effectively impede, limit, block, and/or seal the port 16 against airflow therethrough, while permitting enough clearance for collected condensate to effectively flow over or around the condensate wall 28 and through the port 16.

Figure 4:
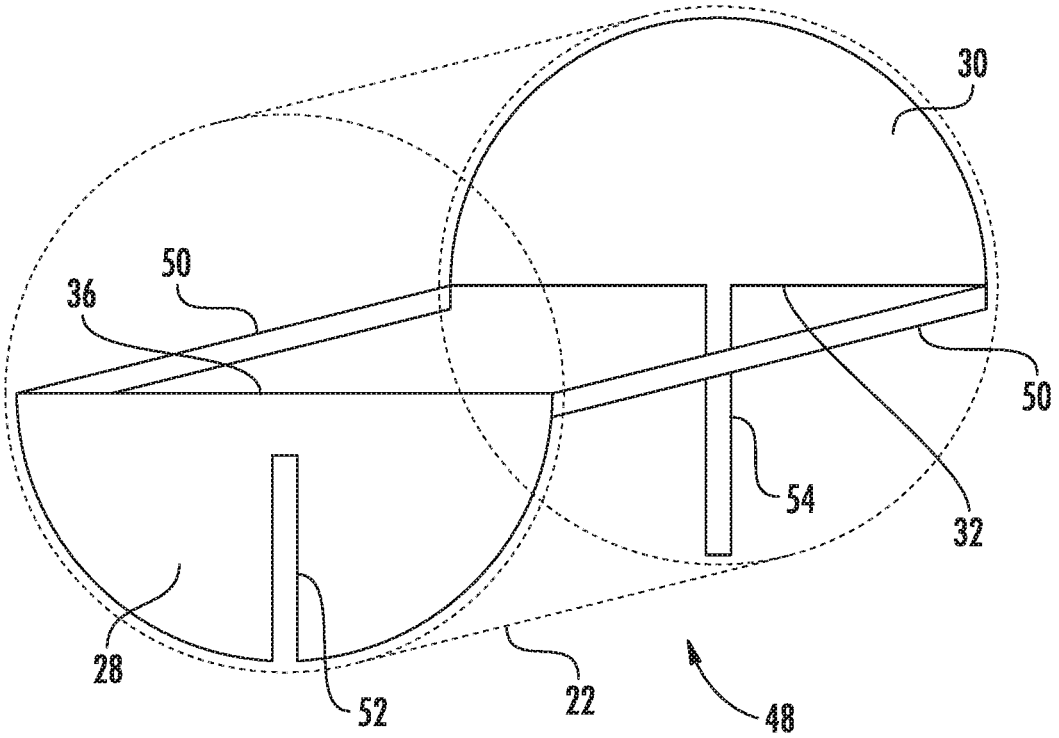
FIG. 4 is a perspective view of a condensate drain pan port insert in accordance with an embodiment of the present disclosure.

Referring now to FIG. 4, a condensate drain pan port insert 48 is illustrated in accordance with one or more embodiments of the present disclosure. The condensate drain pan port insert 48 includes the condensate wall 28 and the air wall 30, each being configured in accordance with one or more embodiments of the condensate drain pan port 16 described herein. The drain pan port insert 48 of the embodiment of FIG. 4 does not include the port housing 22, but includes one or more connecting members 50 extending between the condensate wall 28 and the air wall 30. The drain pan port insert 48 of one embodiment not illustrated includes the port housing 22. In one or more embodiments, the drain pan port insert 48 is provide or configured as a kit or modular article for retrofitting of and/or incorporation with a separate condensate drain pan or drain pan port.

The insert 48 includes a drainage opening 52 in the condensate wall 28 in the illustrated embodiment. Although not illustrated, one or more of the embodiments of the drain pan port 16 described above also include the drainage opening 52. The drainage opening 52 is configured as a slot extending vertically in the illustrated embodiment. The drainage opening 52 is configured as another shape and/or size in additional embodiments not illustrated. The drainage opening 52 is sized and shaped to allow a remainder of collected condensate to flow through the insert 48 while significantly restricting the flow of air through the drainage opening 52. Therefore, a condensate drain pan coupled to the insert 48 may drain more completely by allowing the collected condensate to be removed through the drain opening 52. Although not illustrated, in one embodiment, the area of the opening of the drainage opening 52 is less than an area of the opening between the condensate wall 28 and the air wall 30.

As further illustrated in FIG. 4, the insert 48 further includes an air wall support 54 extending from the lower edge 32 of the air wall 30 along the second plane 38. The air wall support 54 provides support for the insert 48 to allow the insert 48 to be positioned properly within the drain pan port 16. The air wall support 54 is sized and/or configured to minimize impedance of condensate flow through the drain pan port 16.

One will appreciate that the embodiments described in the present disclosure provide the condensate drain pan 10, condensate drain pan port 16, and condensate drain pan port insert 48 to improve flow of collected condensate through the condensate drain pan port 16 during one or more conditions. Such conditions may exist where flow of collected condensate through the drain pan port 16 is impeded by airflow from the area above condensate drain pan 10, a high pressure condition present within the HVAC/R equipment, and/or another condition impeding flow through the drain pan port 16.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. An HVAC/R unit, comprising:

an evaporator coil; and a port configured to remove condensate away from the evaporator coil, the port, comprising:

a port housing having an upper end and a lower end;

a condensate wall extending upward from the lower end; and an air wall extending downward from the upper end and being configured to limit an airflow through the port housing;

wherein the condensate wall is axially spaced a predetermined axial distance from the air wall to provide clearance for condensate to flow over the condensate wall;

wherein a lower edge of the air wall is offset from an upper edge of the condensate wall by a predetermined, positive radial distance.

2. The HVAC/R unit of claim 1, wherein the upper edge and the lower edge are straight.

3. The HVAC/R unit of claim 1, further comprising a drainage opening in the condensate wall.

4. A condensate drain pan port insert, comprising:

a condensate wall extending to an upper edge along a first plane;

an air wall extending to a lower edge along a second plane spaced axially from the first plane and being configured to limit an airflow through the port housing;

wherein the condensate wall is axially spaced a predetermined axial distance from the air wall to provide clearance for condensate to flow over the condensate wall wherein the lower edge of the air wall is offset from the upper edge of the condensate wall by a predetermined, positive radial distance.

5. The condensate drain pan port insert of claim 4, further comprising at least one connecting member extending between the condensate wall and the air wall.

6. The condensate drain pan port insert of claim 4, further comprising a drainage opening in the condensate wall.

7. The condensate drain pan port insert of claim 4, further comprising an air wall support extending from the lower edge along the second plane.

8. A condensate drain pan, comprising:

an outer wall having a condensate drain pan port, the condensate drain pan port having a port housing having an upper end and a lower end;

a condensate wall extending upward from the lower end; and an air wall extending downward from the upper end and configured to limit an airflow through the port housing;

wherein the condensate wall is axially spaced a predetermined axial distance from the air wall to provide clearance for condensate to flow over the condensate wall;

wherein a lower edge of the air wall is offset from an upper edge of the condensate wall by a predetermined, positive radial distance.

9. The condensate drain pan of claim 8, wherein the upper edge and the lower edge are straight.

10. The condensate drain pan of claim 8, further comprising a drainage opening in the condensate wall.

* * * * *